United States Patent [19]

Gillingwater

[11] 4,049,025

[45] Sept. 20, 1977

[54] WIRE BENDING FIXTURE

[76] Inventor: Abel R. Gillingwater, 947 Wall St., Jeffersonville, Ind. 47130

[21] Appl. No.: 661,007

[22] Filed: Feb. 24, 1976

[51] Int. Cl.[2] ..... B21F 1/04; B21F 45/00

[52] U.S. Cl. ..... 140/102.5; 140/123

[58] Field of Search ..... 72/DIG. 16, 457, 460, 72/461; 140/102, 102.5, 104, 123

[56] References Cited

U.S. PATENT DOCUMENTS

| | | | |
|---|---|---|---|
| 319,206 | 6/1885 | Dodge | 140/102 |
| 638,538 | 12/1889 | Williams | 140/102 |
| 681,251 | 8/1901 | Nigg | 140/102.5 |
| 880,235 | 2/1908 | Neller | 140/104 |
| 1,042,112 | 10/1912 | Hartman | 140/102 |
| 2,456,532 | 12/1948 | Perazzo | 140/102.5 |

*Primary Examiner*—E. M. Combs

*Attorney, Agent, or Firm*—Clarence A. O'Brien; Harvey B. Jacobson

[57] ABSTRACT

A hand operated wire bender for forming an easel back for a picture frame, and the method of using same. A planar base plate is provided with a series of circular knobs on one surface for shaping the wire and a spaced bar is provided on the opposite surface for bending the wire.

4 Claims, 6 Drawing Figures

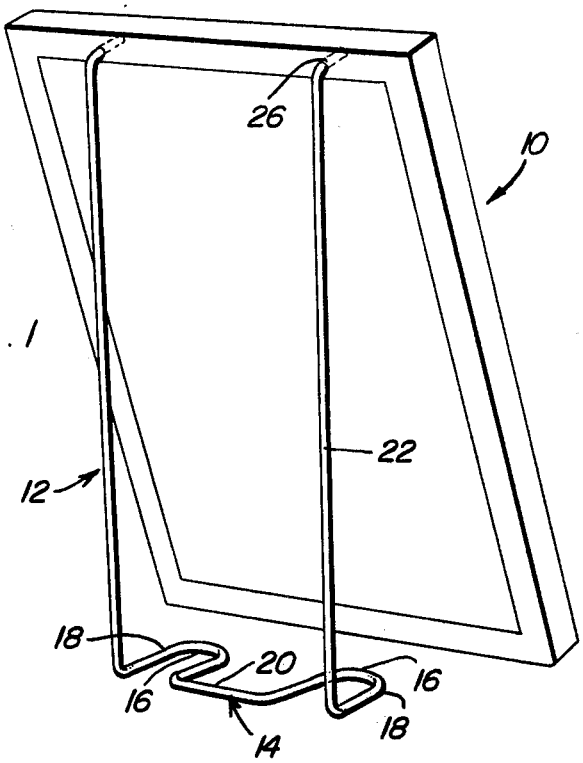
Fig. 1
Fig. 2
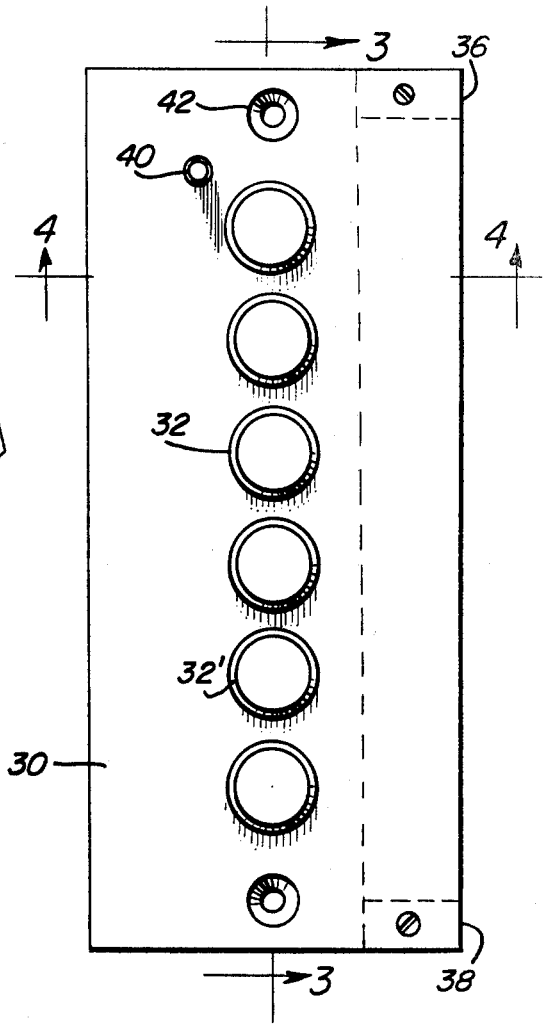
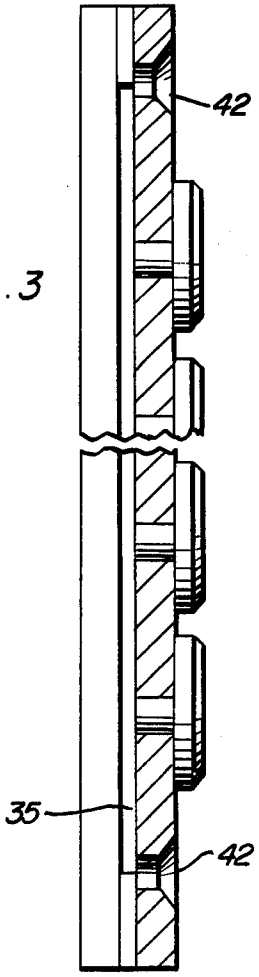
Fig. 3
Fig. 4
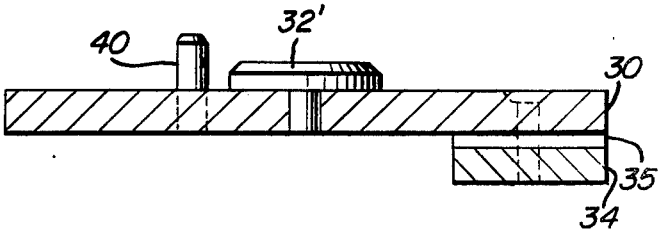

WIRE BENDING FIXTURE

BACKGROUND OF THE INVENTION

1. Field of the Invention

Picture frames come in variety of sizes, some standard, many individual. These frames may be displayed on horizontal surfaces such as desks, tables, mantels, and the like, and it is necessary that the frames be provided with means to prop them up for display. To that end easel backs have been devised which are made of bent wire having a horizontal base component and a vertical prop component. When the frames are of an individual size the easel backs are required to be made by hand, and it is to facilitate this arrangement that the present wire bending apparatus and method have been devised.

2. Description of the Prior Art

U.S. Pat. No. 11,186 to Weed discloses the method of winding wire around pins on a board to provide a frame for a bonnet.

U.S. Pat. No. 1,114,384 to Prime discloses a method of winding metal blank, in the form of ribbon, which method employs pins as well as heat for setting the metal blank in shape.

U.S. Pat. No. 1,013,958 to Schroter discloses winding ductile wire filaments to a given prearranged shape.

Hartmann U.S. Pat. No. 1,042,112 discloses an apparatus comprising a template with holes, and pins insertable therein, around which pins concrete reinforcement rods are wound. Levers pivoted on the pins twist the rods in a variety of shapes.

Bechtell U.S. Pat. No. 3,039,498 discloses apparatus for forming lead wires with a predetermined shape and size by means of moving cams.

None of the above cited patents disclose the bending of wire by hand to form a picture frame easel back of different sizes on the same fixture.

SUMMARY OF THE INVENTION

The object of the present invention is to manually form from wire an individually sized easel back having a generally predetermined shape, the dimensions of the horizontal and vertical portions of which are optional.

A further object is to form the wire easel back, easily, in little time, and uniformly so as to give professional result. The easel back is detachable and economical to make in this manner, which involves using an instrument having no moving parts, but which allows variations in the dimensions of the finished product.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a view of the bent wire easel back in its desired configuration, supporting a picture frame.

FIG. 2 is a top view of the instrument to form the easel back.

FIG. 3 is a broken longitudinal sectional view take on line 3—3 of FIG. 2, but showing the winding knobs in full view.

FIG. 4 is a cross-sectional view taken on line 4—4 of FIG. 2.

DESCRIPTION OF THE PREFERRED EMBODIMENT

Figure 5:
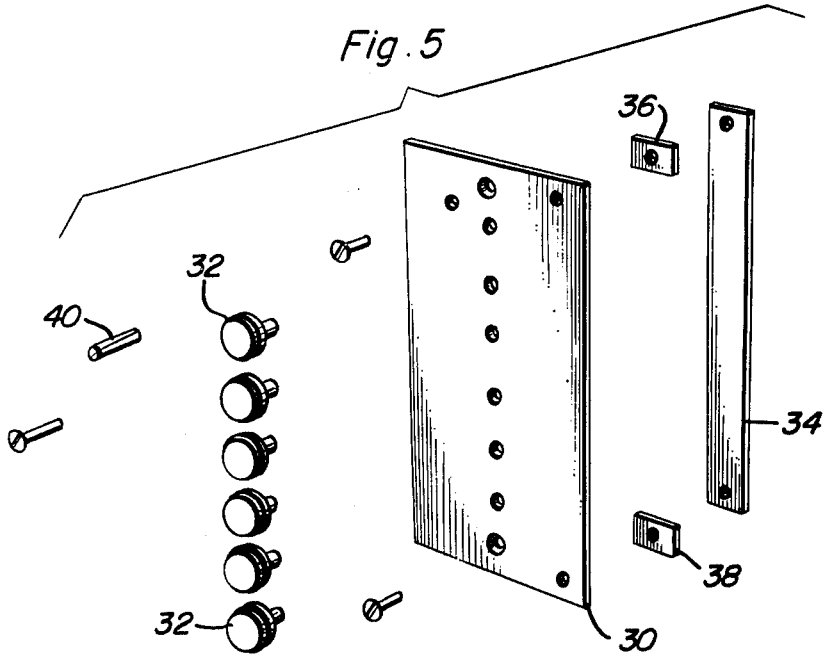
FIG. 5 is an exploded view of the apparatus shown in FIG. 2.

In FIG. 1 of the drawings, there is shown a picture frame generally designated as 10, and having a wire easel back generally designated as 12. The wire easel back 12 has a base portion 14 which comprises spaced U-shaped members 16 connected by a straight member 20, all of which are in the same horizontal plane. The outer leg 18 of each U-shaped member 16 may vary in length, and is connected to a vertical prop leg 22 at an obtuse angle so that the prop leg is forwardly inclined in the direction of the bight of the U-shaped member. The opposite ends of the prop legs are bent to extend in the same direction as the horizontal base and at about a 90° angle as shown at 26, to engage in spaced apertures at the top back of the picture frame for vertical support.

Figure 6:
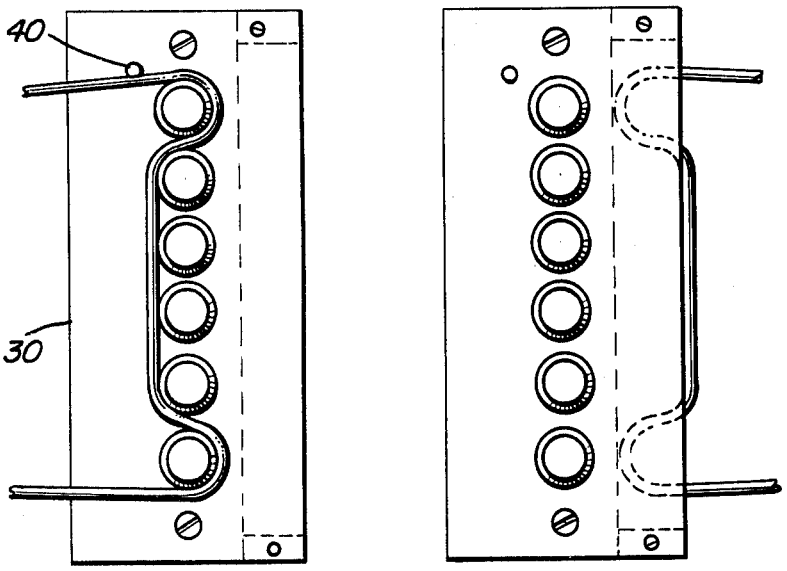
FIG. 6 is a view of successive steps in the formation of the wire easel back on the apparatus of FIG. 2.

The apparatus for forming the easel back 12 as shown in FIGS. 2, 5, and 6 comprises a flat rectangular plate 30 having a series of spaced knobs or discs 32 projecting from its upper surface in a longitudinal row parallel to and midway the longitudinal edges of the plate. These knobs 32 are chamfered or beveled at their top 32' to facilitate the winding of wire about them. A longitudinal bar 34 having the same length and approximately ¼ the width of the plate 30, is attached at the corners of one longitudinal side of the bottom surface of the plate 30 by means of two spacer elements 36, 38 screwed therethrough. This leaves an opening 35 between the bar 34 and the plate 30. A stop pin 40 is secured to and extends above the upper surface of the plate at a position near the top edge of the plate and to the side of the series of knob opposite the bar 34. The stop pin 40 is positioned laterally of the first knob of the series so that a tangent line drawn between the wire engaging surfaces of the stop pin and knob defines an angle less than 90° with the center line of the series of knobs. This angular relationship is illustrated by the wire in FIG. 6. This allows for a certain amount of springback of the wire when removed from the fixture.

Countersunk holes for flat head screws for mounting the plate on a work surface are provided as at 42. The size of the components and the number of knobs used will vary with the dimensions of the easel back. The length of the vertical prop legs 22 may be varied with the dimensions of the picture frame, as the length of the connecting member 20 may be varied to change the width of the base, and the extent of the outer legs 18 of the U-shaped members may be varied to change the depth of the base. These dimensions are determined by the operator. The depth of the bight of the U-shaped member is fixed by the diameter of the knob. The wire bender apparatus may be made of metal such as aluminum or of plastic.

To form the easel back, the operator uses wire having a diameter of approximately 0.093 inches. The wire is placed across the plate between the stop pin 40 and the top knob 32 leaving a free end about ¼ inch greater than the heiight of the easel back. The remainder of the wire is threaded partially around one or more knobs to form a U-shaped member, as shown in FIG. 6, then drawn across the next series of knobs to form the straight connecting portion 20 and then threaded partially around the next knob or knobs to form the second U-shaped member and the free remaining end of the wire is drawn back out across the plate in the same general direction as the entering portion. The shaped wire is then removed. The free ends of the wire may be flipped by had reversing the direction of the bights of the U-shaped horizontal base. The base portion then is inserted within the slot 35 formed between bar 34 and plate 30 to the depth desired, before bending the protruding free ends of the wire against the edge of the slot to form the vertical prop legs 22 of the easel back. The top ends of prop legs 22 are manually bent to form the ends 26 which is detachably insertable within the top of the back of frame 10.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A wire bending fixture for shaping a length of wire comprising, means for forming the wire into a picture frame easel back including, a planar base plate having a top and bottom surface, a series of more than three spaced wire shaping knobs permanently arranged in a straight row on said top surface, a stop pin on said top surface laterally spaced from the first knob of said series, and a wire bending bar opposite to and spaced from said bottom surface of the plate and co-extensive with an edge thereof, the base plate being rectangular and the knobs mounted in a row parallel to and midway the longitudinal edges of the plate, said stop pin being positioned laterally of and above the first knob of the series so that a tangent line drawn between the wire engaging surfaces of the stop pin and knob defines an angle less than 90° with the center line of the series of knobs, the bar being aligned with the longitudinal edge of the plate farthest from the stop pin, and secured to the plate by spacer elements affixed to the upper and lower corners of the plate.

2. A wire bending fixture as in claim 1, wherein the knobs are circular and chamfered to facilitate the winding of the wire.

3. A wire bending fixture as in claim 2, wherein the bar is less than ½ the width of the plate.

4. A wire bending fixture as in claim 3 having upper and lower mounting holes in the planar base plate for mounting on a work surface.

* * * * *